US006152264A

United States Patent [19]

Gaines, Sr. et al.

[11] Patent Number: 6,152,264

[45] Date of Patent: Nov. 28, 2000

[54] LIFT TRUCK WORK PLATFORM WITH PIVOTING WINGS

[75] Inventors: Robert E. Gaines, Sr.; Robert E. Gaines, II, both of Bells, Tenn.

[73] Assignee: Fork Mate L.L.C., Bells, Tenn.

[21] Appl. No.: 09/354,477

[22] Filed: Jul. 15, 1999

[51] Int. Cl.[7] ..... E04G 1/00

[52] U.S. Cl. ..... 182/223; 182/152; 182/2.1; 182/141

[58] Field of Search ..... 182/223, 129, 182/148, 152, 131, 141, 2.1

[56] References Cited

U.S. PATENT DOCUMENTS

| | | | |
|---|---|---|---|
| 3,301,348 | 1/1967 | Hiyama | 182/131 |
| 3,472,337 | 10/1969 | Atchey | 182/2 |
| 3,842,933 | 10/1974 | Clark | 182/2 |
| 3,908,793 | 9/1975 | Vaughn | 182/152 |
| 4,620,612 | 11/1986 | Enoki et al. | 182/113 |
| 4,919,230 | 4/1990 | Langer | 182/223 |
| 4,962,827 | 10/1990 | Garnett | 182/2 |
| 4,971,169 | 11/1990 | Fruth | 182/150 |
| 5,555,953 | 9/1996 | Henderson | 182/141 |

FOREIGN PATENT DOCUMENTS

| | | | |
|---|---|---|---|
| 5222833 | 8/1993 | Japan | 182/150 |

OTHER PUBLICATIONS

De–Sta–Co, Manual Clamps–Models 323,331,341 (date unknown).

*Primary Examiner*—Alvin Chin-Shue
*Attorney, Agent, or Firm*—Walker, McKenzie & Walker, P.C.

[57] ABSTRACT

A work platform for use with a lift truck. The work platform has a pair of wing platforms that are pivotally hinged to a center platform. The work platform has a wing-extended position in which the wing platforms are extended from the center platform so as to provide an extended-length work platform, and further has a transport position in which the wing platforms are pivoted about their respective vertical hinges so as to provide a reduced-width work platform for transport along a highway while loaded on the bed of a transport truck. A removable guard fence is provided for safety around the perimeter of the work platform. Hold-down latches secure the guard fence to the work platform, and latches secure the wing platforms in the transport position and in the wing-extended position.

5 Claims, 4 Drawing Sheets

FIG. 6
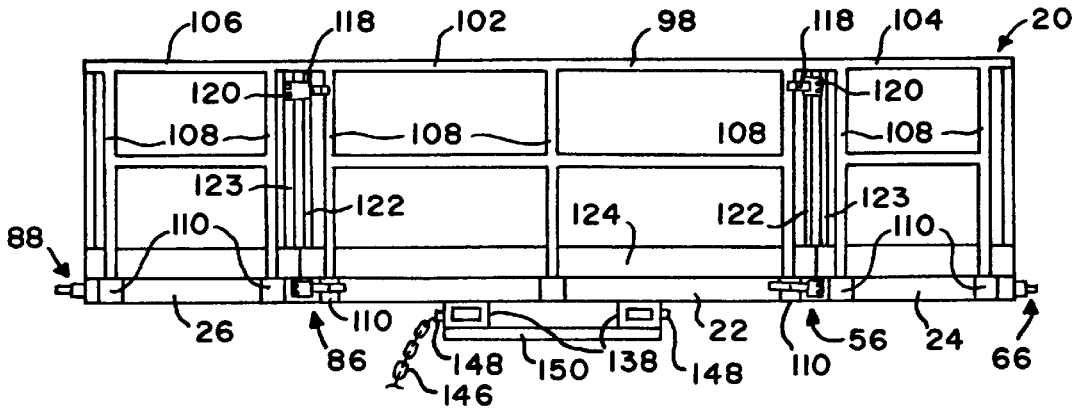
FIG. 7
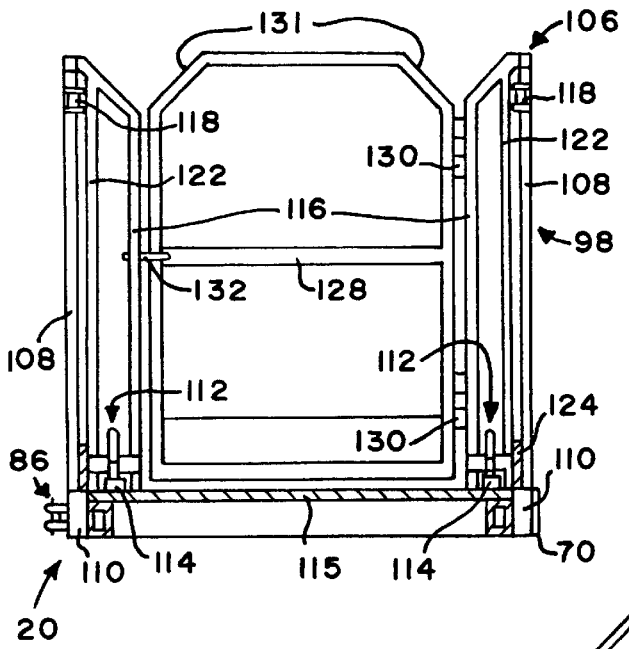
FIG. 8
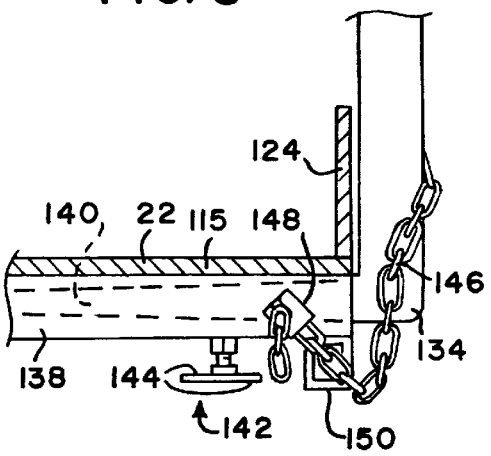
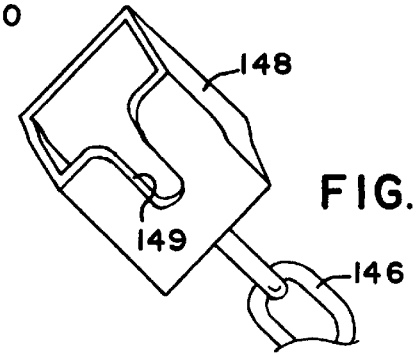
FIG. 8A

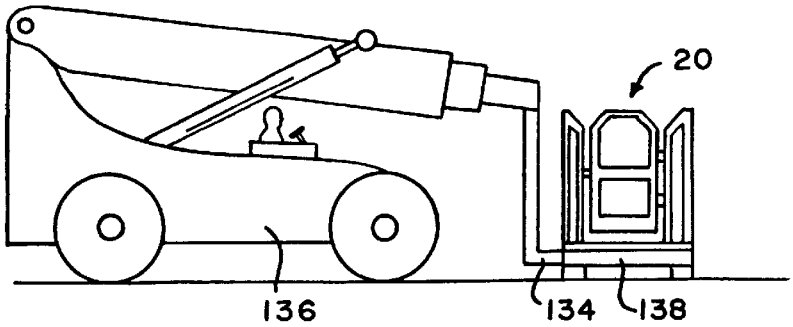
FIG. 9
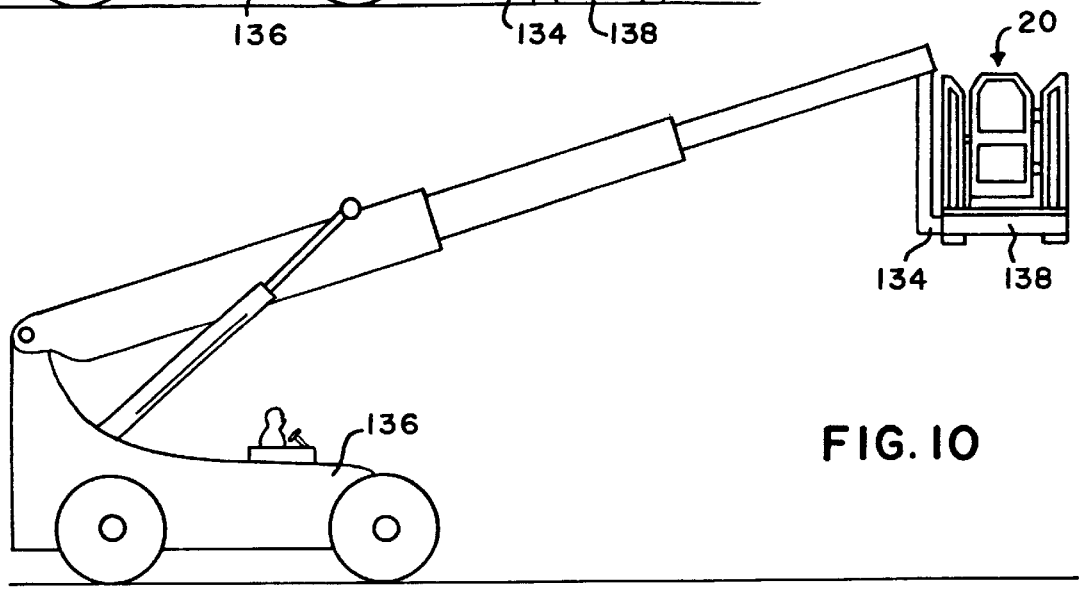
FIG. 10
FIG. 11
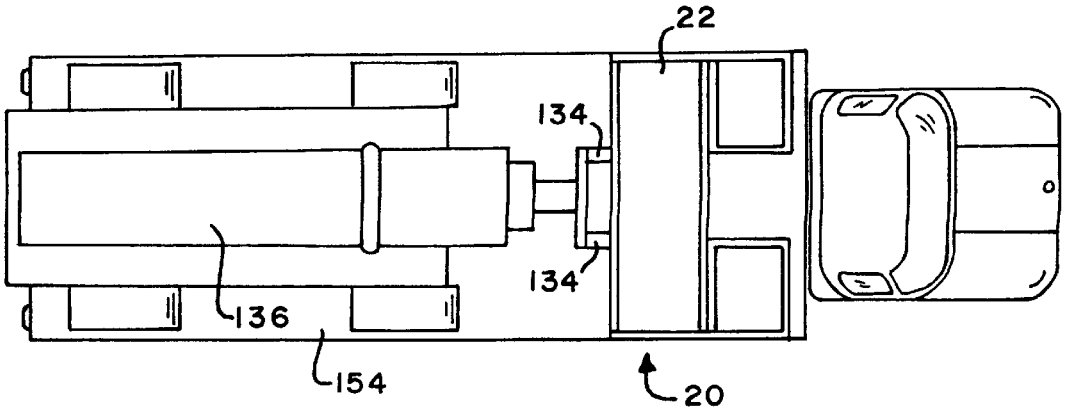

LIFT TRUCK WORK PLATFORM WITH PIVOTING WINGS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION

1. Field of the Invention

The present invention relates, in general, to scaffolding and work platforms, and in particular, to a portable work platform that can be raised and lowered.

2. Information Disclosure Statement

In recent years, fork lift trucks and, in particular, so-called well-known "shooting boom" fork lift trucks, have become very popular in the building trades, for construction services, and for many other uses. It is often desired to elevate one or more workmen in order to work on an elevated job or workpiece in an otherwise inaccessible area. The safety of such elevated workers is of primary concern. Elevating scaffolding apparatus are known that have dedicated machinery for raising and lowering the scaffolding, but the machinery, typically being integral with the scaffolding, cannot be used for any purpose than to elevate the scaffolding.

It is therefore desirable to have an elevating platform for use with a lift truck, whereby the lift truck can be used to safely lift workers on the platform and further whereby the lift truck can still be used for other purposes when an elevated scaffolding platform is not needed.

Furthermore, there are highway regulations that limit the width of transported loads that are carried down a highway on the bed of a transport truck. It is therefore further desirable to provide an elevating platform that has an extended-width deck on which workers may stand while working at an elevated position, and that further has a reduced width for transport along a highway when loaded onto the bed of a transport truck.

A preliminary patentability search in Class 182, subclasses 223, 63.1, 2.8, 113, and 222, produced the following patents, some of which may be relevant to the present invention: Hiyama, U.S. Pat. No. 3,301,348, issued Jan. 31, 1967; Atchey, U.S. Pat. No. 3,472,337, issued Oct. 14, 1969; Clark, U.S. Pat. No. 3,842,933, issued Oct. 22, 1974; Enoki et al., U.S. Pat. No. 4,620,612, issued Nov. 4, 1986; Garnett, U.S. Pat. No. 4,962,827, issued Oct. 16, 1990; and Henderson, U.S. Pat. No. 5,555,953, issued Sep. 17, 1996.

Additionally, the inventors of the present invention hereby disclose well-known prior art over-center toggle locking action manual clamps sold by DE-STA-CO Industrial Products, P.O. Box 2800, Troy, Mich. 48007, as manual clamp models 323, 331, and 341.

None of these references, either singly or in combination, disclose or suggest the present invention.

BRIEF SUMMARY OF THE INVENTION

The present invention is a work platform for use with a lift truck. The work platform has a pair of wing platforms that are pivotally hinged to a center platform. The work platform has a wing-extended position in which the wing platforms are extended from the center platform so as to provide an extended-length work platform, and further has a transport position in which the wing platforms are pivoted about their respective vertical hinges so as to provide a reduced-width work platform for transport along a highway while loaded on the bed of a transport truck. A removable guard fence around the perimeter of the work platform is provided for safety of workers supported by the work platform, and the guard fence is secured in place by a plurality of latches.

It is an object of the present invention to provide a work platform for use with a lift truck, whereby the lift truck can be used to safely lift workers on the platform and further whereby the lift truck can still be used for other purposes when an elevated scaffolding platform is not needed.

It is a further object of the present invention to provide an elevating platform that has an extended-width deck on which workers may stand while working at an elevated position, and that further that has a reduced width for transport along a highway when loaded onto the bed of a transport truck.

BRIEF DESCRIPTION OF THE SEVERAL VIEWS OF THE DRAWING

FIG. 6 is a rear view of the present invention with the side wing platforms extended, taken substantially along the line 6—6 shown in FIG. 1.

FIG. 7 is a transverse sectional view of the present invention showing the fence hold-down latches and taken substantially along the line 7—7 shown in FIG. 1.

FIG. 8 is a partial sectional view showing a tine of a fork lift supporting the present invention and showing the details of a tine set screw and one end of the tine retaining chain, taken substantially along the line 8—8 shown in FIG. 1.

FIG. 8A is a perspective view showing the details of the chain anchor block for the tine retaining chain.

FIG. 9 is a side view showing a fork lift truck approaching the present invention prior to the lifting thereof.

FIG. 10 is a side view showing a fork lift truck lifting the present invention above the ground.

FIG. 11 is a top view showing the present invention, with both side wing platforms pivoted into the transport position, loaded with a lift truck onto the bed of a transport truck.

DETAILED DESCRIPTION OF THE INVENTION

Figure 1:
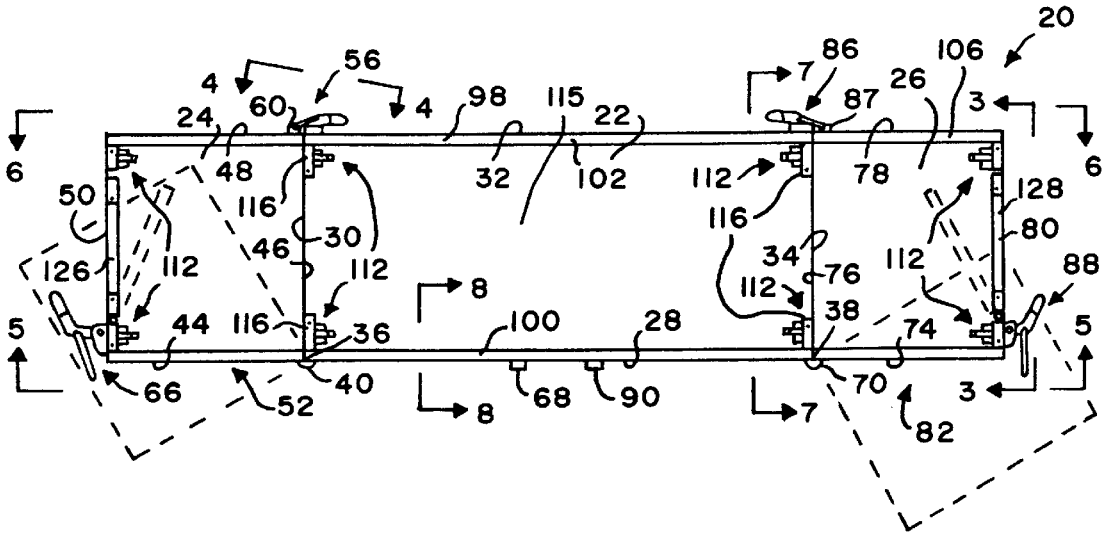
FIG. 1 is a top plan view of the present invention with the side wing platforms extended and showing the hinged pivoting of the side wing platforms.

Referring to FIGS. 1–8, work platform 20 is seen to comprise a generally rectangular center platform 22, and first and second wing platforms 24, 26 respectively hingedly secured to center platform 22. Preferably, work platform 20 is of an all steel, welded construction for strength, safety, and durability.

Center platform 22 is nominally 8 feet (2.4 meters) in length along its front and rear sides and 42 inches (106.7 cm.) wide along its ends, having, in clockwise sequence as viewed from the top, a center platform front side 28, a center platform first end 30, a center platform rear side 32, and a center platform second end 34. Center platform front side 28 and center platform first end 30 meet at a first corner 36, while center platform front side 28 and center platform second end 34 meet at a second corner 38.

First and second wing platforms 24, 26 are substantially mirror images of each other, both being generally rectangular and about 3 feet (0.9 meters) in length along their front sides and 42 inches (106.7 cm.) wide along their ends.

Figure 2:
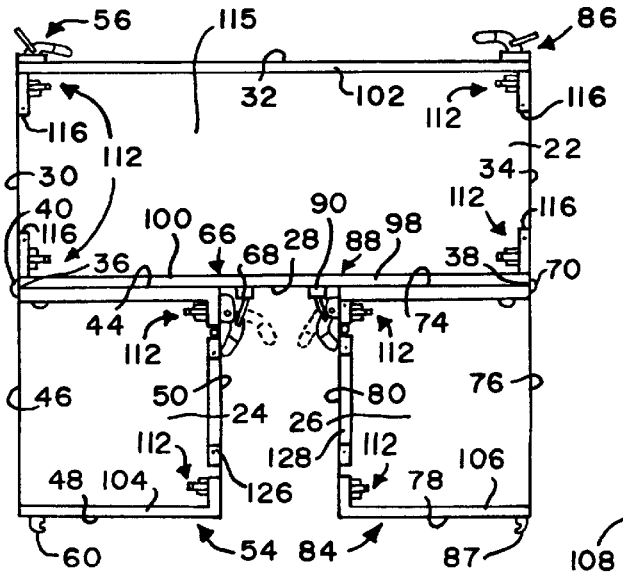
FIG. 2 is a top view of the present invention with the side wing platforms pivoted into the transport position.

First wing platform 24 is hingedly secured to center platform 22 at first corner 36, as by a first hinge 40 joining center platform 22 to first wing platform 24, so as to permit hinged movement of first wing platform 24 with respect to center platform 22 about a first vertical axis 42. First wing platform 24 has, in counterclockwise sequence as viewed from the top, a first wing front side 44, a first wing first end 46, a first wing rear side 48, and a first wing second end 50. First wing platform 24 has a first wing extended position 52, as shown in FIG. 1, in which first wing first end 46 is adjacent center platform first end 30, and first wing platform 24 further has a first wing transport position 54, as shown in FIG. 2, in which first wing front side 44 is adjacent center platform front side 28. First wing platform 24 hingedly pivots on first hinge 40 about first vertical axis 42 so as to move, as shown in dotted outline in FIG. 1, between first wing extended position 52, as shown in FIG. 1, and first wing transport position 54, as shown in FIG. 2.

First hinge 40 allows 180-degree movement of first wing platform 24, and is preferably formed in a well-known manner of three sections of round steel tubing with a cylindrical hinge pin received vertically therethrough so as to form the pivoting first hinge axis 42 about which first hinge 40 pivots. Upon removing the cylindrical pin, the first wing platform 24 can then be removed from center platform 22.

Figure 4:
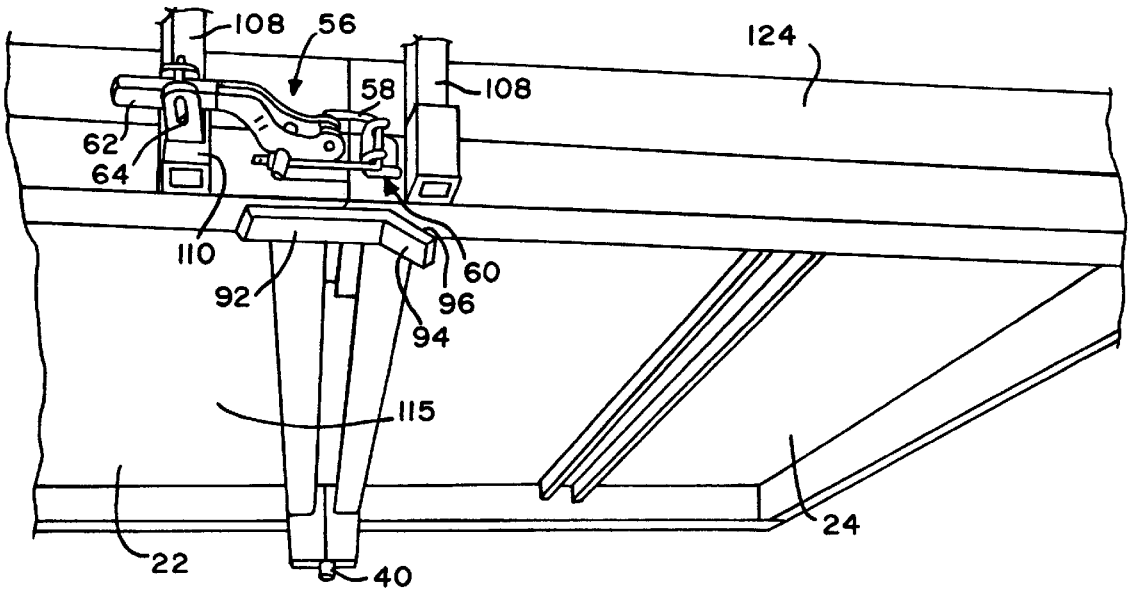
FIG. 4 is a perspective partial underside view of the invention showing a wing extension closure support and a wing extension latch, taken substantially along the line 4—4 shown in FIG. 1.
Figure 5:
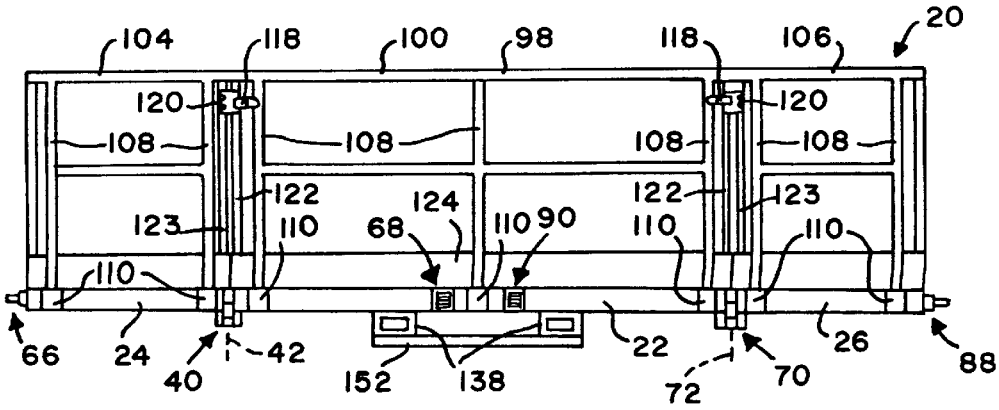
FIG. 5 is a front view of the present invention with the side wing platforms extended, taken substantially along the line 5—5 shown in FIG. 1.

As shown best in FIG. 4, first wing platform 24 is safely secured in first wing extended position 52 by first wing extension latch means 56, preferably a well-known manual clamp sold by DE-STA-CO Industrial Products, P.O. Box 2800, Troy, Mich. 48007, as a model 341 manual clamp having a 2000 pound (907 Kg.) holding capacity with an over-center toggle locking action and an ergonomic handle grip. A threaded U-bolt 58 of first wing extension latch means 56 matingly engages and secures first wing extension latch hooks 60 to hold first wing platform 24 in the extended position, and the handle 62 of first wing extension latch means 56 is preferably secured as by a pin 64 so as to prevent inadvertent release of first wing platform 24 from the first wing extended position.

Similarly, when positioned into the first wing transport position 54, first wing platform 24 is secured by similar first wing transport latch means 66, also preferably a well-known manual clamp sold by DE-STA-CO Industrial Products as a model 341 manual clamp having a 2000 pound (907 Kg.) holding capacity with an over-center toggle locking action and an ergonomic handle grip. First wing transport latch means 66 matingly engages with first wing transport latch hooks 68 to secure first wing platform 24 in the first wing transport position 54.

Second wing platform 26 is hingedly secured to center platform 22 at second corner 38, as by a second hinge 70 joining center platform 22 to second wing platform 26, so as to permit hinged movement of second wing platform 26 with respect to center platform 22 about a second vertical axis 72. Second wing platform 26 has, in clockwise sequence as viewed from the top, a second wing front side 74, a second wing first end 76, a second wing rear side 78, and a second wing second end 80. Second wing platform 26 has a second wing extended position 82, as shown in FIG. 1, in which second wing first end 76 is adjacent center platform second end 34, and second wing platform 26 further has a second wing transport position 84, as shown in FIG. 2, in which second wing front side 74 is adjacent center platform front side 28. Second wing platform 26 hingedly pivots on second hinge 70 about second vertical axis 72 so as to move, as shown in dotted outline in FIG. 1, between second wing extended position 82, as shown in FIG. 1, and second wing transport position 84, as shown in FIG. 2.

Second hinge 70, substantially similar to first hinge 40, allows 180-degree movement of second wing platform 26, and is preferably formed in a well-known manner of three sections of round steel tubing with a cylindrical hinge pin received vertically therethrough so as to form the pivoting second hinge axis 72 about which second hinge 70 pivots. Upon removing the cylindrical pin, the second wing platform 26 can then be removed from center platform 22.

In a like manner as disclosed hereinbefore for first wing platform 24, second wing platform 26 is safely secured in second wing extended position 82 by second wing extension latch means 86, substantially similar to first wing extension latch means 56 hereinbefore described and also preferably a well-known model 341 manual clamp sold by DE-STA-CO Industrial Products having a 2000 pound (907 Kg.) holding capacity with an over-center toggle locking action and an ergonomic handle grip. Similar to first wing extension latch means 56, the manual clamp of second wing extension latch means 86 engages second wing extension latch hooks 87 so as to secure second wing platform 26 in extended position 82. Likewise, when positioned into the second wing transport position 84, second wing platform 26 is secured by second wing transport latch means 88, substantially similar to first wing transport latch means 58 and also preferably a well-known model 341 manual clamp sold by DE-STA-CO Industrial Products and having a 2000 pound (907 Kg.) holding capacity with an over-center toggle locking action and an ergonomic handle grip. Similar to first wing transport latch means 66, the manual clamp of second wing transport latch means 88 engages second wing transport latch hooks 90 so as to secure second wing platform 26 in second wing transport position 84.

Referring to FIG. 4, the wing extension closure support 92 is shown. It shall be understood that each wing platform is supported by a similar wing extension closure support 92 when in the wing extended position, and a description of wing extension closure support 92 for first wing platform 24 will suffice for the wing extension closure supports for both of wing platforms 24, 26. Wing extension closure support 92 is weldedly secured to center platform 22 and extends longitudinally past the end of center platform 22. A downwardly-angled portion 94 of closure support 92 forms a ramp 96 that guides the wing platform 24 into vertical alignment with center platform 22 as wing platform 24 pivotingly approaches the wing extended position, thereby ensuring alignment for securing of wing extension latch means 56 and also thereby providing structural vertical support for wing platform 24 while in the wing extended position and substantially removing vertical stresses from wing extension latch means 56.

Referring to FIGS. 1–7, work platform 20 preferably includes a removable safety or guard fence 98 peripherally extending upward from center platform 22 and from first and second wing platforms 24, 26. Guard fence 98 includes center platform front and rear fence portions 100, 102, and further includes C-shaped first and second wing platform fence portions 104, 106. It shall be understood that first and second wing platform fence portions 104, 106 are substantially mirror images of each other, and a description of one suffices for both.

Guard fence 98 is preferably about 43 inches (109 cm.) tall with a plurality of upstanding standards 108 that are slidably and removably matingly received into a like plurality of fourteen sockets 110 that are spaced about the perimeter of work platform 20. For safety and to ensure that guard fence 98 does not inadvertently become detached from work platform 20, eight fence hold-down latch means 112, all substantially similar, are provided for securing guard fence 98 to work platform 20. Hold-down latch means 112, best seen in FIG. 7 and partially seen in FIG. 3, preferably are each a well-known model 331 manual clamp sold by DE-STA-CO Industrial Products and having a 700 pound (318 Kg.) holding capacity with an over-center toggle locking action and an ergonomic handle grip. Similar to first wing transport latch means 66, the manual clamp of hold-down latch means 112 engages fence hold-down latch hooks 114 fixedly mounted on the deck 115 of work platform 20 so as to secure guard fence 98 to the deck of work platform 20.

At either end of center platform front and rear fence portions 100, 102 there are provided buttress supports 116, for a total of four such buttress supports 116, that securely support front and rear fence portions 100, 102 in the vertically upright position. Adjacent the top of guard fence 98 and at each of the junctions of center platform front and rear fence portions 100, 102 with first and second wing platform portions 104, 106 are recessed fence closure latches 118, for a total of four such fence closure latches 118, each preferably being a well-known model 331 manual clamp sold by DE-STA-CO Industrial Products and having a 700 pound (318 Kg.) holding capacity with an over-center toggle locking action and an ergonomic handle grip. Similar to first wing transport latch means 66, the manual clamp of fence closure latches 118 engages closure latch hooks 120 so as to secure the portions of guard fence 98 together when the wing platforms are in the extended position. Fence closure latches 118 and closure latch hooks 120 are recessed from the perimeter of work platform 20, with fence closure latches 118 being mounted to the recessed outer standards 122 of the buttress supports 116 and with fence closure latch hooks 120 being mounted to similarly-recessed upstanding standards 123 of first and second wing platform portions 104, 106, so as to permit pivoting of wing platforms 24, 26 into the transport position without interference with fence closure latches 118. A steel baseboard plate 124 is provided at the bottom of guard fence 98 for structural integrity and to prevent tools and the like from rolling off of the deck of work platform 20.

Figure 3:
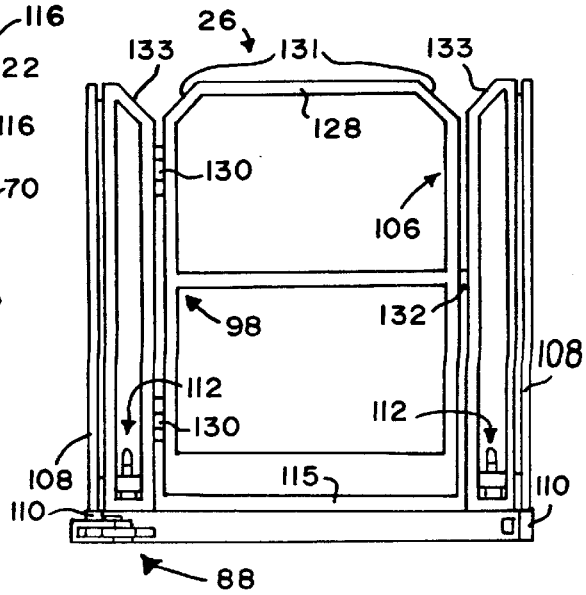
FIG. 3 is an end view of the present invention, taken substantially along the line 3—3 shown in FIG. 1. The view from the opposite end is substantially a mirror image.

As best seen in FIGS. 1, 3 and 7, gates 126 and 128 are provided at either end of work platform 20 to allow workers to enter and exit from the work platform. Gates 126 and 128 are substantially mirror images of each other, and a description of gate 128 suffices for both. Gate 128 is hingedly attached to guard fence 98 in a well-known manner as by hinges 130, and a well-known safety latch 132 is provided to secure gate 128 in the closed position. As shown in dotted outline in FIG. 1, both gates 126, 128 preferably, for safety, hinge only inwardly to open so that a worker standing on the deck of work platform 20 cannot lean on the gates and cause them to inadvertently open outward when work platform 20 is elevated. For safety reasons, upper corners 131, 133 of guard fence 98 may be preferably beveled where the hinged gates are adjacent the stationary wing platform fence portions.

Referring to FIGS. 5, 6, 8, and 9, the two tines 134 of a lift truck 136 are respectively received into two rectangular lifting guide tube beams 138 that are transversely welded to the underside of work platform 20, with the ends 140 of tines 134 extending into lifting guide tube beams 138 for constraining tines 134 within lifting guide tube beams 138 while work platform 20 is elevated by lift truck 136. The two lifting guide tube beams 138 are substantially similar, and a description of one suffices for both. As seen best in FIG. 8, each lifting guide tube beam 138 has a tine set screw 142 secured thereto and reciprocatingly extending within the interior of its guide tube beam 138 for contactingly securing its respective tine 134 within its guide tube beam 138 as tine set screw 142 is screwingly advanced into the interior of its guide tube beam as by rotating tine set screw 142 by radial wing grips 144. A tine retaining chain 146 is provided as a secondary safety mechanism for retaining tine 134 within guide tube beam 138, with a chain anchor block 148 being attached to each guide tube beam 138 for restrainingly securing the opposite ends of tine retaining chain 146 in a manner well-known to those skilled in the art. It shall be understood that the chain anchor blocks 148 of each guide tube beam 138 are substantially similar, and a description of one suffices for both.

FIG. 8A shows a perspective detail of chain anchor block 148 with tine retaining chain 146 being inserted through the lower end of chain anchor block 148. Chain anchor block 148 is a length of about 2 inch by 2 inch (5 cm by 5 cm), in transverse dimensions, of steel tubing being weldedly diagonally mounted onto tine guide tube beam 138. An upwardly-facing slot 149 in the outer face of chain anchor block 148 is provided to receive and secure a link of tine retaining chain 146. To anchor the end of tine retaining chain 146 within chain anchor block 148, the end of the chain is inserted upwardly through the lower-facing opening of chain anchor block 148 as shown in FIG. 8A, and chain 146 is then passed upwardly through chain anchor block 148 and, after the chain 146 has been passed through chain anchor block 148, an intermediate link of the chain 146 is slidably received into upwardly-facing slot 149 and is thereby retained by slot 149 as shown in FIG. 8. The two ends of tine retaining chain 146 are similarly secured by their respective chain anchor blocks 148, and it has been found that some slack must be left in tine retaining chain 146 to allow for slight shifting of tine 134, but the slack in chain 146 should not be so excessive as to permit tine 134 to release its lifting support of work platform 20.

Referring again to FIGS. 5, 6, 8, and 9, a pair of longitudinal beams 150, 152 welded to the underside of lifting guide tube beams 138 provide structural integrity for guide tube beams 138 and further provide supports for resting work platform 20 on the ground while also elevating guide tube beams 138 above the ground so that tine set screws 142 will not be damaged and can be adjusted while work platform 20 is resting on the ground, and still further allow for ease of inserting tines 134 into guide tube beams 138.

Referring to FIGS. 9–11, the operation and use of the work platform 20 can now be explained. Work platform 20 is first placed upon the ground at a work site and the wing platforms are placed into in the extended position as heretofore described. The operator of lift truck 136 causes the tines 134 of lift truck 136 to be inserted into guide tube beams 138, in a manner heretofore described, and, after tines 134 are secured within guide tube beams 138 as also heretofore described, workers enter through the gates at either end of work platform and then latch the gates. The lift truck 136 will then lift work platform 20 into the air with one or more workers standing upon the deck of work platform 20, and the workers then proceed to work from an elevated position on a now-accessible workpiece. After work is completed by the workers, the work platform 20 is lowered to the ground, the workers exit via the gates at either end of the work platform 20, and the wing platforms can be placed into the transport position as heretofore described. Work platform 20 can then be placed upon the bed of a transport truck 154 for transport to another job site. The shortened length of the work platform 20 when in the transport position allows the work platform 20 to travel along a highway atop transport truck 154 together with lift truck 136 and still have the load width for transport truck 154 be within the maximum permitted width for highway travel.

Although the present invention has been described and illustrated with respect to a preferred embodiment and a preferred use therefor, it is not to be so limited since modifications and changes can be made therein which are within the full intended scope of the invention.

We claim:

1. A work platform for use with a lift truck, said work platform comprising:

(a) a generally rectangular center platform having, in sequence, a center platform front side, a center platform first end, a center platform rear side, and a center platform second end; said center platform front side and said center platform first end meeting at a first corner and said center platform front side and said center platform second end meeting at a second corner; and (b) first and second wing platforms respectively hingedly secured to said center platform at said first and said second corners, respectively, for 180 degree hinged movement with respect to said center platform about a first and a second vertical axis, respectively; each said wing platform having, in sequence, a wing front side, a wing first end, a wing rear side, and a wing second end;

said first wing platform having a first wing extended position in which its entire wing first end is adjacent said center platform first end, and said first wing platform having a first wing transport position, 180 degrees hingedly pivoted from said first wing extended position about said first vertical axis, in which its entire wing front side is adjacent said center platform front side;

said second wing platform having a second wing extended position in which its entire wing first end is adjacent said center platform second end, and said second wing platform having a second wing transport position, 180 degrees hingedly pivoted from said second wing extended position about said second vertical axis, in which its entire wing front side is adjacent said center platform front side; first and second wing extension latch means for respectively securing said first and second wing platforms respectively in said first and second extended positions with respective third and forth corners of the center platform being latched to respective adjacent corners of the first and second wing platforms in said extended position; and first and second wing transport latch means for respectively securing said first and second wing platforms respectively in said first and second transport positions, said wing platforms having diametrically opposed corners to respective said adjacent corners, said diametrically opposed corners being latched to the front side of the center platform when in said transport positions.

2. The work platform as recited in claim 1, in which said work platform further comprises a guard fence peripherally extending upward from said center platform and said first and second wing platforms.

3. The work platform as recited in claim 2, in which said work platform further has a plurality of sockets spaced about the perimeter of said work platform into which said guard fence is removably received.

4. The work platform as recited in claim 3, in which said work platform further has a plurality of fence hold-down latch means for securing said guard fence to said work platform.

5. A work platform for use with a lift truck, said work platform comprising:

(a) a generally rectangular center platform having, in sequence, a center platform front side, a center platform first end, a center platform rear side, and a center platform second end; said center platform front side and said center platform first end meeting at a first corner and said center platform front side and said center platform second end meeting at a second corner;

(b) first and second wing platforms respectively hingedly secured to said center platform at said first and said second corners, respectively, for 180 degree hinged movement with respect to said center platform about a first and a second vertical axis, respectively; each said wing platform having, in sequence, a wing front side, a wing first end, a wing rear side, and a wing second end;

said first wing platform having a first wing extended position in which its entire wing first end is adjacent said center platform first end, and said first wing platform having a first wing transport position, 180 degrees hingedly pivoted from said first wing extended position about said first vertical axis, in which its entire wing front side is adjacent said center platform front side;

said second wing platform having a second wing extended position in which its entire wing first end is adjacent said center platform second end, and said second wing platform having a second wing transport position, 180 degrees hingedly pivoted from said second wing extended position about said second vertical axis, in which its entire wing front side is adjacent said center platform front side;

(c) a guard fence peripherally extending upward from said center platform and said first and second wing platforms; said work platform having a plurality of sockets spaced about the perimeter of said work platform and said guard fence being removably received into said plurality of sockets;

(d) a plurality of fence hold-down latch means for securing said guard fence to said work platform;

(e) first and second wing extension latch means for respectively securing said first and second wing platforms respectively in said first and second wing extended positions with respective third and forth corners of the center platform being latched to respective adjacent corners of the first and second wing platforms in said extended position; and (f) first and second wing transport latch means for respectively securing said first and second wing platforms respectively in said first and second wing transport positions, said wing platforms having diametrically opposed corners to respective said adjacent corners, said diametrically opposed corners being latched to the front side of the center platform when in said transport positions.

* * * * *